United States Patent [19]

Cottell

[11] Patent Number: 4,465,607

[45] Date of Patent: Aug. 14, 1984

[54] LUBRICATING COMPOSITION CONTAINING POLYTETRAFLUOROETHYLENE, AND A PROCESS AND SYSTEM FOR MANUFACTURING SAME

[76] Inventor: Eric C. Cottell, Windermere, Bayville, Long Island, N.Y. 11709

[21] Appl. No.: 421,080

[22] Filed: Sep. 22, 1982

[51] Int. Cl.[3] ..... C10M 1/30

[52] U.S. Cl. ..... 252/58; 252/25; 252/359 R; 252/359 A; 252/359 D

[58] Field of Search ..... 252/58, 25, 359 R, 359 A, 252/359 D

[56] References Cited

U.S. PATENT DOCUMENTS

| | | | |
|---|---|---|---|
| 3,039,969 | 6/1962 | Colucci et al. | 252/49.5 X |
| 3,194,762 | 7/1965 | Browning et al. | 252/25 X |
| 3,247,116 | 4/1966 | Reiling | 252/58 |
| 3,432,511 | 3/1969 | Reiling | 252/58 X |
| 4,048,963 | 9/1977 | Cottell | 431/1 X |
| 4,127,332 | 11/1978 | Thiruvengadam et al. | 252/359 D |
| 4,218,221 | 8/1980 | Cottell | 44/51 |
| 4,400,177 | 8/1983 | Cottell | 44/51 |

*Primary Examiner*—Andrew Metz

[57] ABSTRACT

A lubricating composition of essentially only a lubricating oil and particles of polytetrafluoroethylene uniformly dispersed and suspended in the lubricating oil. The lubricating composition is manufactured by sonically agitating a mixture of lubricating oil and particles of polytetrafluoroethylene at sufficiently high energy levels to produce violent cavitation. The sonic agitation is provided by an ultrasonic generating device in a system whereby the mixture is sonically agitated as it continuously passes through the ultrasonic generator.

7 Claims, 2 Drawing Figures

LUBRICATING COMPOSITION CONTAINING POLYTETRAFLUOROETHYLENE, AND A PROCESS AND SYSTEM FOR MANUFACTURING SAME

BACKGROUND OF THE INVENTION

The present invention relates to lubricating compositions, and more particularly to an emulsion of a lubricating oil and particles of polytetrafluoroethylene substantially evenly dispersed and suspended therein. The present invention further relates to a process for manufacturing this lubricating composition, and still further to a system for manufacturing this lubricating composition.

Lubricating compositions of oil and polytetrafluoroethylene, and various processes for making them, are known. For example, U.S. Pat. No. 3,247,116, issued on Apr. 19, 1966 to Victor G. Reiling, is directed to a lubricating composition of powdered, degraded polytetrafluoroethylene resin in a liquid vehicle wherein the polytetrafluoroethylene resin is degraded by heating the resin to a temperature of between 785° F. and 880° F. for a period of about two hours before blending it with a liquid carrier.

U.S. Pat. No. 3,933,656, issued on Jan. 20, 1976 to Franklin G. Reick, is directed to a lubricating oil additive composed of a commercially available aqueous dispersion of sub-micron polytetrafluoroethylene particles and a charge neutralizing agent, such as a silane. The silane allegedly stabilizes the dispersion to prevent agglomeration and coagulation of the polytetrafluorethylene particles. This dispersion is mixed with a quantity of lubricating oil, which functions here as a carrier, to produce the additive which is to be added to the lubricating oil in the crankcase of an internal combustion engine. The polytetrafluoroethylene has a tendency to settle, but redispersion is effected with the mildest agitation, taking care to avoid violent agitation since this will cause irreversible coagulation.

U.S. Pat. No. 4,224,173, issued on Sept. 23, 1980 to Franklin G. Reick, is directed to a lubricant formed of a commercially available aqueous dispersion of submicron polytetrafluoroethylene particles to which a fluro surfactant is added to neutralize the surface charge on the particles to prevent agglomeration. The stabilized aqueous dispersion is added to a lubricating oil, which acts as a carrier, and the mixture is subjected to a turbulent treatment to disperse the colloidal polytetrofluoroethylene in the lubricating oil carrier. A polymeric dispersant is also added to promote homogenization. An absorbent surfactant, which is appropriate to the metals to be lubricated, is added to the homogenized emulsion to promote adhesion of the lubricant to the surfaces of the parts to be lubricated.

The processes heretofore known to me do not produce a lubricating composition in which the polytetrafluoroethylene is adequately suspended therethrough such as to provide a commercially desirable product with a sufficiently long shelf life. Furthermore, these heretofore known processes require steps which are necessarily time consuming and therefore commercially expensive, or which involve the addition of extraneous materials to accomplish stability of the polytetrafluoroethylene in suspension which materials increase the cost of manufacture while contributing little, or nothing to the lubrication properties of the composition.

SUMMARY OF THE INVENTION

The present invention recognizes the drawbacks of the prior art and provides a process, manufacturing system and lubricating composition which obviates these drawbacks.

The present invention provides a process for manufacturing a lubricating composition comprising the steps of mixing lubricating oil with from about 1% to about 20% by weight of polytetrafluoroethylene particles of between about 1 micron to about 200 microns in size, and violently agitating the mixture at an energy density sufficiently high to cause cavitation of the mixture.

The present invention also provides a lubricating emulsion consisting essentially of only polytetrafluoroethylene particles and lubricating oil resulting from a process comprising the steps of mixing lubricating oil with from about 1% to about 20% by weight of polytetrafluoroethylene particles of between about 1 and 200 microns in size, and violently agitating the mixture at an energy density sufficiently high to cause cavitation of the mixture.

The present invention further provides a system for manufacturing the lubricating composition comprising a supply of lubricating oil, a supply of polytetrafluoroethylene particles, means for admixing the lubricating oil and polytetrofluoroethylene particles, ultrasonic generating means for violently agitating the mixture of lubricating oil and polytetrafluoroethylene particles to cause cavitation as the mixture continuously moves through it, and means for continuously transferring the mixture through the sonic generating means.

BRIEF DESCRIPTION OF THE DRAWINGS

The present invention will become even more clear upon reference to the following description and accompanying Figures wherein.

DETAILED DESCRIPTION OF THE PREFERRED EMBODIMENT

Figure 1:
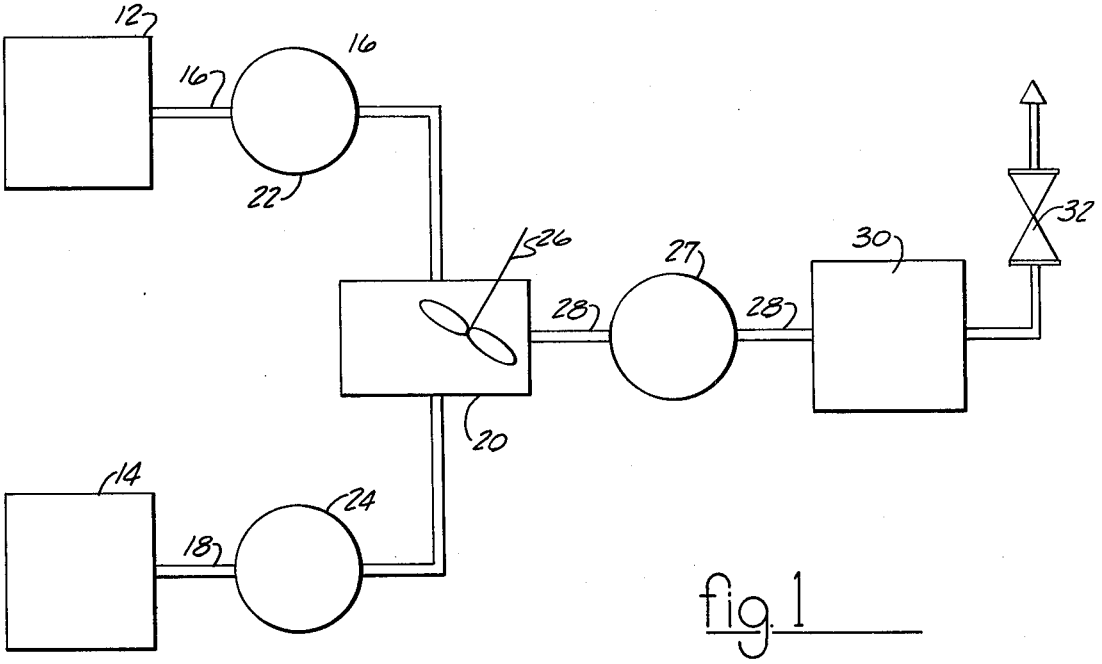
FIG. 1 schematically represents a system for carrying out the process of the present invention to make the polytetrafluoroethylene in oil emulsion of the present invention; and, FIG. 2 is an ultrasonic generating device used in the system of FIG. 1.

FIG. 1 schematically illustrates a system for manufacturing an emulsion of polytetrafluoroethylene particles in a lubricating oil.

The system, generally denoted as the numeral 10, is illustrated as comprising a source of polytetrafluoroethylene particles 12 and a source of lubricating oil 14. The polytetrafluoroethylene particles from the polytetrafluoroethylene source 12 and the lubricating oil from the oil source 14 are pumped through appropriate conduits 16 and 18, respectively, to a slurry tank 20 by means of, for example, pumps 22 and 24 in the conduits 16 and 18, respectively. As shown, the slurrying is accomplished by a conventional mixing agitator 26 in the slurry tank 20. The slurry is transferred from the slurry tank 20 by means of, for example, a pump 27 through an appropriate conduit 28 and through a sonic generating device 30. A throttling device 32 is located downstream at the outlet of the sonic generating device 30 to create a back pressure in the sonic generating device 30.

Figure 2:
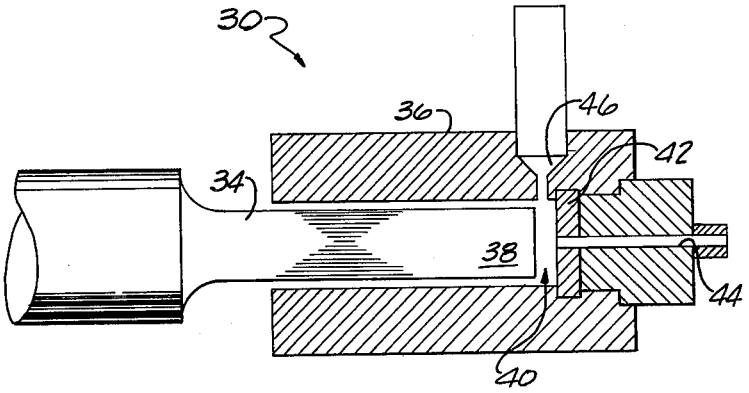

The sonic generating device 30 is preferrably an ultrasonic generating device. One such device which works well in the present invention is disclosed in my U.S. Pat. No. 4,048,963. As can be best seen in FIG. 2, the sonic generator device 30 comprises an acoustic probe 34 which projects into a housing 36 and terminates at a vibrating end 38 in a treatment chamber 40 defined within the housing. A plate 42, formed with an emulsion outlet passageway 44 therethrough generally coaxial with the longitude of the acoustic probe 34, is located across the treatment chamber 40 from the vibrating probe end 38. A slurry inlet passageway 46 is formed through the wall of the housing 36 into the treatment chamber 40 between the vibrating probe end 38 and plate 42. Thus, the slurry to be emulsified enters the treatment chamber 40 at the periphery of the plate 42 and moves inwardly therefrom to the emulsion outlet passageway 44.

In operation, polytetrafluoroethylene particles of between about 1 and about 200 microns in size are supplied from the polytetrafluoroethylene source 12 through the conduit 16 to the slurry tank 20, and lubricating oil is supplied from the oil source.14 through the conduit 18 to the slurry tank 20. The polytetrafluoroethylene particles and lubricating oil are admixed in the slurry tank 20 by the mechanical agitator 26. The mixture consists of from about 1% to about 20% by weight of polytetrafluoroethylene particles.

The polytetrafluorethylene-oil slurry is transferred from the slurry tank 220 through the conduit 28 and continuously moves through the sonic generator 30. The mixture enters the treatment chamber 40 through the slurry inlet passageway 46 and is emulsified as it moves inwardly of the chamber 40 from the periphery of the plate 42 toward the emulsion outlet passageway 44. The acoustic probe 34 generates an energy density of between 50 to about 500 watts per square centimeter and operates in the frequency range of about 10,000 to 30,000 cycles per second. The pressure internal to the treatment chamber 40 is increased above atmospheric by the throttling means 32 downstream of the emulsion outlet passageway 44. Improved emulsion stability has been obtained at pressures of about 10 to 200 psi gauge. As the slurry passes through the treatment chamber 40 from the slurry inlet passageway 46 to the outlet passageway 44, it is subjected to a violent agitation sufficient to cause cavitation.

It is suspected that the pressurization of the treatment chamber above atmospheric pressure further reduces the polytetrafluoroethylene particle size and prevents the formation of large spherical agglomerates, thereby, contributing to the stability of the resulting mixture or dispersion. The lubricating emulsion produced by this process essentially comprises substantially uniformly dispersed particles of polytetrafluoroethylene in suspension throughout the lubricating oil.

Polytetrafluoroethylene-oil emulsions containing from about 1% to about 20% by weight of polytetrafluoroethylene manufactured by the above discussed process was tested in a piston diesel injector pump. With ordinary lubricating oil, it was quite difficult to turn the injector pump by hand, and the resistance increased as each of the cam lobs lifted its respective tappet. The crankcase was then drained a sufficient amount to allow the introduction therein of about 5% by volume of the polytetrafluoroethylene-oil emulsion of the present invention, and the injector pump was again turned by hand whereupon it spun easily with no appreciable increase in resistance as the cam lobs lifted the tappets.

The foregoing detailed description is given primarily for clearness of understanding and no unnecessary limitations are to be understood therefrom for modifications will become obvious to those skilled in the art upon reading this disclosure and may be made without departing from the spirit of the invention or scope of the appended claims.

I claim:

1. A process for producing a lubricating composition comprising the steps of:

mixing the lubricating oil with from about 1% to about 20% by weight of polytetrafluoroethylene particles of between about 1 and about 200 microns in size; and, violently sonically agitating the mixture at an energy density sufficiently high to cause cavitation of the mixture.

2. The process of claim 1, wherein the mixture is sonically agitated at an energy density of between about 50 to about 500 watts per square centimeter.

3. The process of claim 2, wherein the mixture is sonically agitated at a frequency of about 10,000 to about 30,000 cycles per second.

4. The process of claim 1, further comprising subjecting the mixture to a pressure greater than atmospheric pressure while agitating the mixture.

5. The process of claim 4, wherein the mixture is subjected to a pressure of about 10 to about 200 pounds per square inch gauge.

6. A system for producing a lubricating composition consisting of an emulsion of polytetrafluoroethylene and lubricating oil comprising:

lubricating oil supply means;

polytetrafluoroethylene supply means;

mixing means for admixing the lubricating oil and polytetrafluoroethylene particles;

sonic generating means for continuously agitating the admixture to cause cavitation and create a substantially stable emulsion as the admixture continuously moves through the sonic generating means; and, means for continuously transferring the admixture through the sonic generating means.

7. The system of claim 6, further comprising means for pressurizing said sonic generating means above atmospheric pressure while agitating the admixture.

* * * * *